US006547535B2

(12) United States Patent
Kueon

(10) Patent No.: US 6,547,535 B2
(45) Date of Patent: Apr. 15, 2003

(54) SUCTION MUFFLER FOR A COMPRESSOR

(75) Inventor: Young-su Kueon, Kwangju (KR)

(73) Assignee: Samsung Kwangju Electronics Co., Ltd., Kwangju (KR)

( * ) Notice: Subject to any disclaimer, the term of this patent is extended or adjusted under 35 U.S.C. 154(b) by 0 days.

(21) Appl. No.: 09/882,524

(22) Filed: Jun. 15, 2001

(65) Prior Publication Data

US 2002/0081217 A1 Jun. 27, 2002

(30) Foreign Application Priority Data

Dec. 21, 2000 (KR) ..... 2000-79612

(51) Int. Cl.[7] ..... F04B 39/00; F04B 53/00
(52) U.S. Cl. ..... 417/312; 181/229
(58) Field of Search ..... 417/312, 417; 181/229

(56) References Cited

U.S. PATENT DOCUMENTS 5,435,700 A * 7/1995 Park ..... 417/312
5,734,134 A * 3/1998 Park ..... 181/229
5,971,720 A * 10/1999 Fagotti et al. ..... 417/312
6,206,135 B1 * 3/2001 Kim et al. ..... 181/229
6,398,523 B1 * 6/2002 Hur et al. ..... 417/417
2002/0098093 A1 * 7/2002 Tomell et al. ..... 417/312

FOREIGN PATENT DOCUMENTS

JP 411062827 * 3/1999 ..... F04B/39/00
JP 02000257556 * 9/2000 ..... F04B/39/00
KR 2001054597 * 7/2001 ..... F04B/39/00

* cited by examiner

*Primary Examiner*—Teresa Walberg
*Assistant Examiner*—Leonid M Fastovsky
(74) *Attorney, Agent, or Firm*—Westman, Champlin & Kelly, P.A.

(57) ABSTRACT

A suction muffler for a compressor employed in a home appliance having a refrigeration cycle reduces noise produced by the compressor. The suction muffler includes a muffler body and a refrigerant suction pipe. The muffler body defines a resonance chamber and is coupled to a refrigerant supply pipe. The refrigerant suction pipe connects the resonance chamber to a compressor cylinder. The refrigerant suction pipe has at least one hole formed in its cylindrical wall. The muffler further includes a guiding portion in the resonance chamber to direct refrigerant from the supply pipe to the at least one hole in the refrigerant suction pipe and to direct noise exiting an upper end of the refrigerant suction pipe away from the refrigerant supply pipe. The suction muffler shortens the refrigerant flow path and lengthens the noise transmission path, thereby reducing the level of noise emitted while increasing efficiency of the compressor.

16 Claims, 4 Drawing Sheets

SUCTION MUFFLER FOR A COMPRESSOR

BACKGROUND OF THE INVENTION

1. Field of the Invention

The present invention relates to a hermetic type compressor, and more particularly to a suction muffler for a hermetic type compressor having an improved structure to reduce the noise transmitted by the compressor during operation.

2. Description of the Related Art

As shown in FIG. 1, a compressor 10 typically used in home appliances, such as refrigerators, includes an outer casing 20 defining a sealed interior space therein, a body 30 received in the outer casing 20 and having a cylinder 50 for compressing a refrigerant, and a suction muffler 40 for reducing noise generated during operation of the compressor.

As shown in FIG. 2, the suction muffler 40 includes a muffler body 41 and refrigerant suction pipe 42. The muffler body 41 is disposed above the cylinder 50 and has a refrigerant supply port 41*b*, which communicates with a refrigerant supply pipe 21. The refrigerant suction pipe 42 connects the interior of the muffler body 41 with a cylinder head portion 51.

In the suction muffler 40 constructed as above, refrigerant flows into the compressor 10 via the refrigerant supply pipe 21, and into a resonance chamber 41 a defined in the muffler body 41 via the refrigerant supply port 41*b*. The refrigerant then flows into the cylinder head portion 51 via the refrigerant suction pipe 42. The path of the refrigerant from the refrigerant supply pipe 21 to the cylinder head portion 51 is indicated by a solid-line arrow of FIG. 2. From the cylinder head portion 51, the refrigerant flows to a cylinder inlet 52 and into an interior of the cylinder 50, where the refrigerant is compressed to high pressure.

As the refrigerant flows through the inlet 52 and an outlet 53 of the cylinder head portion 51, valves (not shown) in the cylinder head portion 51 open and close, producing vibration and noise. The noise exits from the cylinder head portion 51 through the muffler body 41 and the refrigerant supply pipe 21. The path along, which the noise travels, is a reverse of the path of the refrigerant and is indicated by a dotted-line arrow of FIG. 2.

In order to minimize the level of noise from the muffler 40, a noise transmission path within the resonance chamber 41*a* should be as long as possible. Accordingly, the refrigerant suction pipe 42 extends from the bottom of the resonance chamber 41*a* to a predetermined height corresponding to an upper portion of the muffler body 41.

The extended length of the refrigerant suction pipe 42, however, increases a flow resistance for the refrigerant flowing through the muffler 40. Accordingly, the compressing efficiency of the compressor 10 is adversely affected. If the refrigerant suction pipe 42 is shortened, however, then the noise transmission path is also shortened, and accordingly, the compressor 10 will transmit a higher level of noise.

Albeit not shown, the muffler 40 may further include a baffle to reduce the level of noise produced by the compressor 10. Alternatively, the resonance chamber 41*a* of the muffler 40 may have a dual chamber structure. These approaches, however, have several disadvantages, such as complicating the manufacturing process, decreasing productivity, and increasing manufacturing costs.

SUMMARY OF THE INVENTION

The present invention has been made to overcome the above-mentioned problems of the related art, and accordingly, it is an object of the present invention to provide a suction muffler for a compressor having a refrigerant suction pipe and a resonance chamber of an improved structure to reduce the level of noise produced by the compressor.

The above object is accomplished by a suction muffler for a compressor according to the present invention, including a muffler body, a refrigerant suction pipe, and a noise reducing means. The muffler body defines a resonance chamber, which communicates with the refrigerant supply pipe of the compressor. The refrigerant suction pipe for connecting the resonance chamber to a cylinder head portion of the compressor. The noise reducing means is formed in the resonance chamber and reduces the noise that is created by the discharge of refrigerant. The noise reducing means accomplishes this by defining a noise transmission path, through which the noise is transmitted from the cylinder head during the refrigerant discharge, that is separate from a refrigerant flow path, through which a refrigerant flows into the cylinder head portion.

The noise reducing means includes a hole formed in a portion of a cylindrical wall of the refrigerant suction pipe. The hole permits a refrigerant to flow therethrough.

The cylindrical wall of the refrigerant suction pipe may also include a pair of holes formed therein, the holes being located opposite one another.

Further, the noise reducing means includes a guiding portion to direct the refrigerant from the refrigerant supply pipe into the hole, and also to block the diffusion of noise and to direct the noise in a particular direction about the resonance chamber.

The guiding portion includes a portion of the muffler body that is indented toward the refrigerant suction pipe.

BRIEF DESCRIPTION OF THE DRAWINGS

The above objects and other features and advantages of the present invention will become more apparent after a reading of the following detailed description when taken in conjunction with the drawings, in which.

DETAILED DESCRIPTION OF PREFERRED EMBODIMENTS

The preferred embodiments of the present invention will be described in greater detail with reference to the accompanying drawings.

Figure 3:
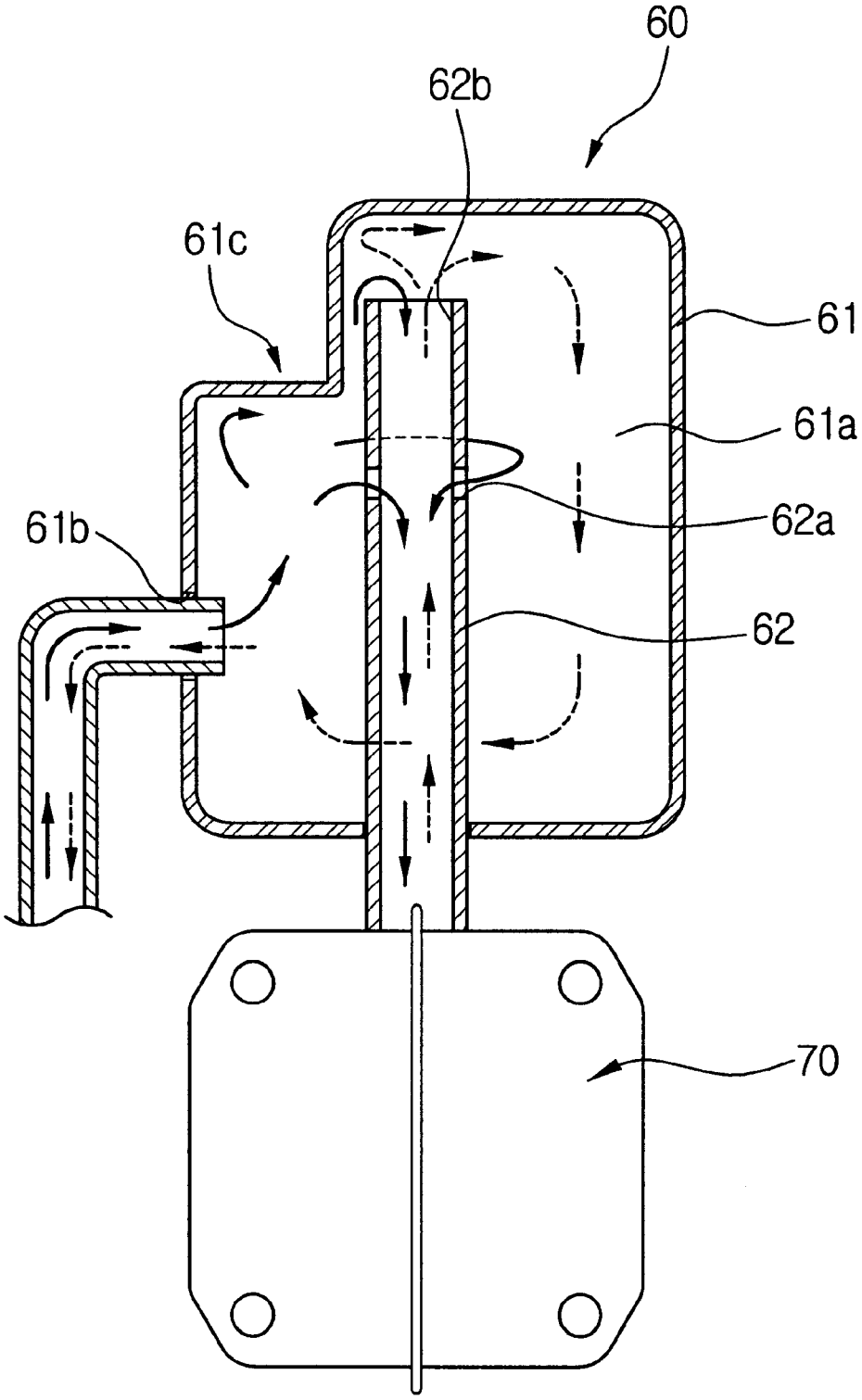
FIG. 3 is a sectional view showing a suction muffler for the compressor, according to a preferred embodiment of the present invention.
Figure 4:
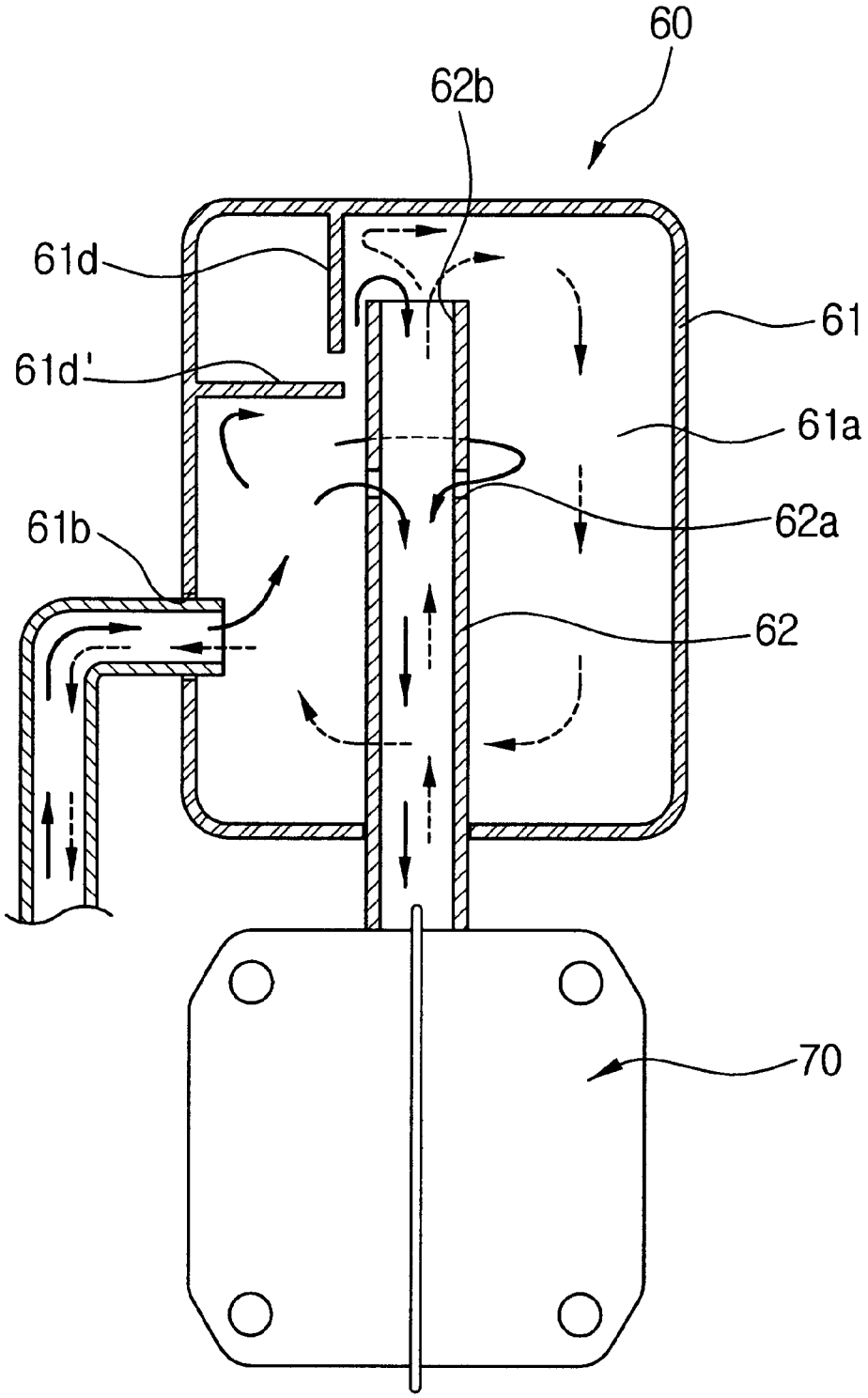
FIG. 4 is a sectional view showing a suction muffler of a compressor according to another preferred embodiment of the present invention.

Referring to FIGS. 3 and 4, a suction muffler 60 for a compressor according to the present invention includes a muffler body 61 and a refrigerant suction pipe 62. The muffler body 61 has a refrigerant supply port 61*b* formed in a side thereof. The refrigerant supply port 61*b* communicates with a refrigerant supply pipe 21. The muffler body 61 defines a sealed resonance chamber 61*a*. The refrigerant suction pipe 62 connects the resonance chamber 61*a* to a cylinder head portion 70 and passes through the bottom surface of the muffler body 61.

The suction muffler 60 further includes a noise reducing means formed on the refrigerant suction pipe 62 for reducing the level of noise generated and transmitted from the cylinder head portion 70.

The noise reducing means includes a hole 62*a* formed on a cylindrical wall of the refrigerant suction pipe 62. The hole 62*a* is a refrigerant suction port that permits refrigerant in the resonance chamber 61*a* to enter the refrigerant suction pipe 62 and flows to the cylinder head portion 70. The refrigerant suction port 62*a* separates the refrigerant flow path, through which refrigerant flows into the cylinder head portion 70 via the refrigerant suction pipe 62, from a noise transmission path, through which noise is transmitted to the muffler body 61.

Refrigerant may flow into the refrigerant suction pipe 62 through the upper inlet 62*b*, which is formed on an upper end of the refrigerant suction pipe 62, and also through the refrigerant suction port 62*a*. The refrigerant suction port 62*a* is preferably formed in a middle portion of the refrigerant suction pipe 62. For more efficient refrigerant suction, two refrigerant suction ports 62*a* may be formed opposite from each other in the cylindrical wall of the refrigerant suction pipe 62 that is disposed in the resonance chamber 61*a*.

To maximize the length of the noise transmission path, it is preferable that the refrigerant suction pipe 62 extend from the bottom to the upper portion of the resonance chamber 61*a*. Thus, noise is transmitted directly to the upper portion of the resonance chamber 61*a*. Here, the upper inner wall of the muffler body 61 and the upper inlet 62*b* of the refrigerant suction pipe 62 are spaced apart from each other by a predetermined distance.

To shorten the refrigerant flow path, thereby reducing flow resistance of the refrigerant, it is preferable that the refrigerant suction port 62*a* is formed at a lower portion of the refrigerant suction pipe 62 in the resonance chamber 61*a* than the upper inlet 62*b*.

In order to further increase the noise reduction efficiency, a guiding portion 61*c* is formed in the resonance chamber 61*a*. The guiding portion 61*c* directs the noise flow in one direction, away from the refrigerant supply port 61*b*, thereby preventing diffusion of the noise and allowing a more efficient refrigerant flow into the refrigerant suction pipe 62. Because of the guiding portion 61*c*, the noise is transmitted along a longer path in the resonance chamber 61*a* before it is expelled through the refrigerant supply port 61*b*.

As shown in FIG. 3, the guiding portion 61*c* includes an indented portion, which is formed by indenting an outer wall of the muffler body 61 above the refrigerant suction port 62*a*. The indented portion is indented proximate the refrigerant suction port 62*a*. The guiding portion 61*c* directs the noise, which is transmitted to the upper inlet 62*b* of the refrigerant suction pipe 62, to circulate in the direction indicated by the dotted-line arrow. The guiding portion 61*c* also guides the inflow of refrigerant, which flows through the refrigerant supply port 61*b*, to flow through the hole 62*a*.

According to another preferred embodiment of the present invention, shown in FIG. 4, a partition 61*d* extends downward from the upper wall of the resonance chamber 61*a*. The partition 61*d* is adjacent to the upper inlet 62*a* of the refrigerant suction pipe 62. The partition 61*d* blocks and guides the noise to one direction.

For a more efficient flow of the refrigerant into the hole 62*a*, a second partition 61*d*' may be also be provided. The second partition 61*d*' extends horizontally inward from a side wall of the resonance chamber 61*a*. The second partition 61*d*' is located proximate the refrigerant supply port 61*b*.

As described above, the guiding portion 61*c* may be formed in many ways, so long as the guiding portion effectively serves its function to block the noise and guide the refrigerant inflow.

The operation of the suction muffler 60 of the compressor according to the present invention will be described in greater detail below.

According to the suction muffler 60 of the compressor constructed as above, after losing energy at the end of a refrigerant cycle, the refrigerant flows into the resonance chamber 61*a* of the muffler body 61 through the refrigerant supply pipe 21 and the refrigerant supply port 61*b*.

Figure 1:
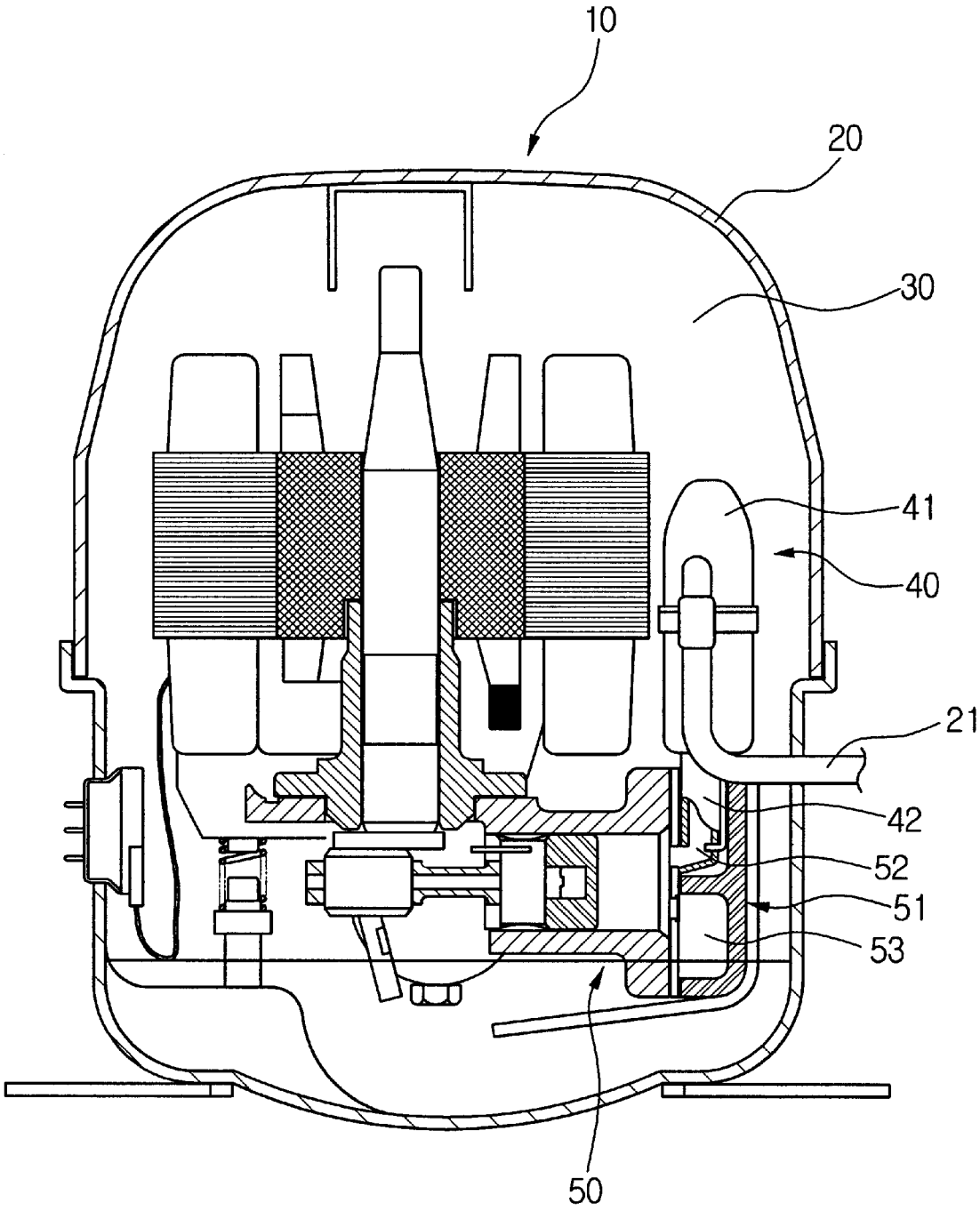
FIG. 1 is a sectional view showing the structure of a conventional compressor.
Figure 2:
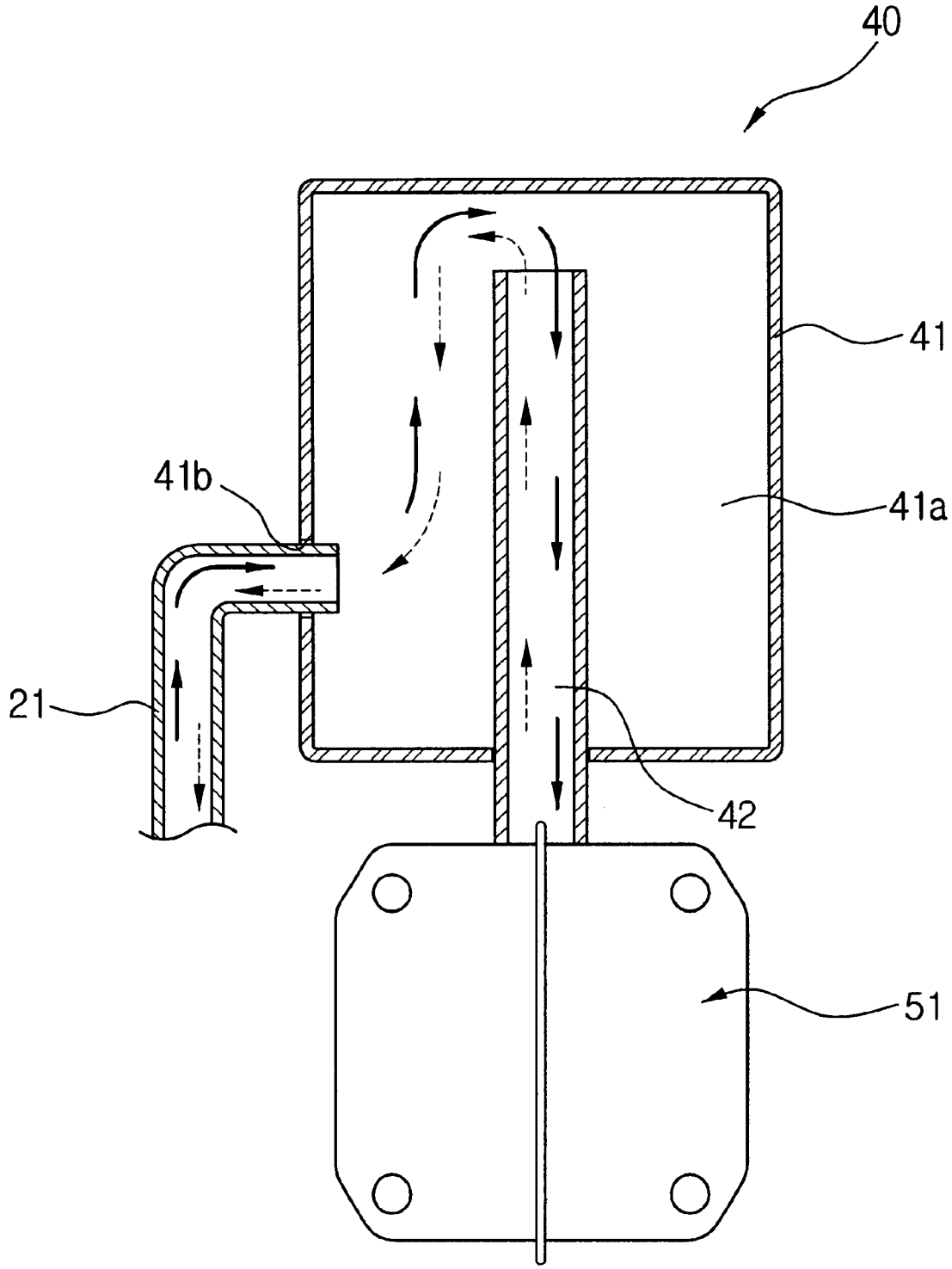
FIG. 2 is a sectional view showing a conventional suction muffler for the compressor.

Then the refrigerant flows in the direction indicated by the solid-line arrow of FIGS. 3 and 4 into the refrigerant suction pipe 62 via the refrigerant suction port 62*a*. Then the refrigerant flows into the cylinder head portion 70 via the refrigerant suction pipe 62, and then into the cylinder 50 (FIG. 1) through the cylinder inlet 52 (FIG. 1).

As shown in FIGS. 3 and 4, the refrigerant may flow into the upper inlet 62*b* and the refrigerant suction port 62*a* respectively formed at the upper and middle portions of the refrigerant suction pipe 62. Since the refrigerant is guided by the guiding portion 61*c* formed on one side of the resonance chamber 61*a* and by the partition 61*d*', most of the refrigerant flows into the refrigerant suction pipe 62 through the refrigerant suction port 62*a* formed in the middle portion of the refrigerant suction pipe 62.

When the refrigerant flows into the cylinder 50 through the above-described path, the refrigerant is compressed by a compressor body 30 (FIG. 1) and discharged from the compressor through the outlet 53 (FIG. 1) formed in the cylinder head portion 70, and circulates in the refrigerant cycle.

While the refrigerant flows in and out with respect to the cylinder head portion 70, noise is produced due to movement of the valves (not shown). As shown in FIGS. 3 and 4, the noise produced from the cylinder head portion 70 is transmitted to the muffler body 61 through the refrigerant suction pipe 62.

After being transmitted through the refrigerant suction pipe 62, the noise is directed past the refrigerant suction port 62*a* formed in the middle portion of the refrigerant suction pipe 62 and to the upper portion of the resonance chamber 61*a*. The noise then circulates in the interior of the muffler body 61 in the direction indicated by the dotted-line arrow.

Here, the noise is directed by the guiding portion 61*c* away from the refrigerant supply port 61*b*, so as to maximize the noise transmission path.

By increasing the length of the noise transmission path, the noise that is output by the compressor is decreased. That is, the noise is reduced as it circulates inside the muffler body 61. The noise is lessened through an interference with the noise, which is newly transmitted to the resonance chamber 61*a*, and then transmitted outside the compressor through the refrigerant supply port 61*b* and the refrigerant supply pipe 21.

Albeit not shown, for a more efficient noise reduction, a noise absorbing member may be stacked on the inner or the outer surface of the refrigerant suction pipe 62 and the muffler body 61. Additional equipment, such as a baffle (not shown), or the like, may also be installed in the suction muffler 60.

As described above, in the suction muffler 60 of the compressor 10 in accordance with the present invention, by forming the refrigerant suction port 62*a* in the cylindrical wall of the refrigerant suction pipe 62, the refrigerant flow path is shortened, and the length of the noise transmission path is maximized.

Accordingly, deterioration of the compressing efficiency, which is caused due to the flow resistance of the refrigerant, can be prevented. Also, by the increased length of the noise transmission path, the noise transmitted outside the compressor 10 can be reduced.

Further, since the noise that is output by the compressor 10 is efficiently controlled by the resonance chamber 61*a*, i.e., simply by forming the refrigerant suction port 62*a* on the cylindrical wall of the refrigerant suction pipe 62, and by indenting a side of the muffler body 61, advantages such as simplified manufacturing processes, increased productivity, and decreased manufacturing costs can be obtained.

Although the preferred embodiment of the present invention has been described, it will be understood by those skilled in the art that the present invention should not be limited to the described preferred embodiment. Various changes and modifications can be made within the spirit and scope of the present invention as defined by the appended claims.

What is claimed is:

1. A suction muffler for a compressor comprising:

a muffler body defining a resonance chamber communicating with a refrigerant supply pipe of the compressor;

a refrigerant suction pipe extending in the muffler body, the refrigerant supply pipe connecting the resonance chamber to a cylinder head portion of the compressor; and noise reducing means formed in the resonance chamber, the noise reducing means defining a noise transmission path, through which noise is transmitted from the cylinder head portion through the refrigerant suction pipe, the resonance chamber and to the refrigerant supply pipe, that is separate from a refrigerant flow path from the refrigerant supply pipe to the cylinder head portion which extends through the resonance chamber and refrigerant suction pipe.

2. The suction muffler of claim 1, wherein the noise reducing means comprises a hole formed in a portion of a cylindrical wall of the refrigerant suction pipe, the hole for permitting the refrigerant to flow through.

3. The suction muffler of claim 2, wherein the noise reducing means comprises a pair of holes formed in the cylindrical wall of the refrigerant suction pipe, the holes being located opposite one another.

4. The suction muffler of claim 2, wherein the noise reducing means includes a guiding portion for directing the refrigerant from the refrigerant supply pipe into the hole and for directing noise about the resonance chamber in a particular direction.

5. The suction muffler of claim 4, wherein the guiding portion comprises an indented portion, the indented portion extending in the resonance chamber toward the refrigerant suction pipe.

6. The suction muffler of claim 4, wherein the guiding portion comprises a vertical partition extending into the resonance chamber proximate an upper end of the refrigerant suction pipe.

7. The suction muffler of claim 6, wherein the guiding portion comprises a second partition extending horizontally into the resonance chamber from a side wall of the muffler body, the partition being located on the side wall proximate the refrigerant suction pipe, the second partition for directing the refrigerant into the hole formed in the cylindrical wall of the refrigerant suction pipe.

8. A compressor comprising:

a cylinder;

a refrigerant supply pipe for supplying a refrigerant to the cylinder; and a suction muffler disposed between the refrigerant supply pipe and the cylinder, the suction muffler including:

a muffler body defining a resonance chamber, the muffler body having a refrigerant supply port in fluid communication with the refrigerant supply pipe;

a refrigerant suction pipe extending in the muffler body, the refrigerant suction pipe connecting the resonance chamber to the cylinder; and noise reducing means formed in the resonance chamber, the noise reducing means defining a noise transmission path from the cylinder through the refrigerant suction pipe and the resonance chamber to the refrigerant supply port which is greater in length than a refrigerant flow path which extends from the refrigerant supply port through the resonance chamber and the refrigerant suction pipe to the cylinder.

9. The compressor of claim 8, wherein the noise reducing means includes a hole formed in a cylindrical wall of the refrigerant suction pipe, the hole permitting refrigerant in the resonance chamber of the muffler to flow into the refrigerant suction pipe and to the cylinder.

10. The compressor of claim 9, wherein the noise reducing means includes a pair of holes formed in the cylindrical wall of the refrigerant suction pipe, the holes being located opposite one another.

11. The compressor of claim 9, wherein the noise reducing means further includes a guiding portion for directing the refrigerant from the refrigerant supply pipe into the hole and for directing noise exiting an upper end of the refrigerant suction pipe away from the refrigerant supply pipe and about the resonance chamber.

12. The compressor of claim 11, wherein the guiding portion includes an indented portion of the muffler body, the indented portion extending in the resonance chamber toward the refrigerant suction pipe.

13. The compressor of claim 11, wherein the guiding portion includes a vertical partition extending in to the resonance chamber proximate the upper end of the refrigerant suction pipe.

14. The compressor of claim 13, wherein the guiding portion includes a second partition extending horizontally into the resonance chamber from a side wall of the muffler body, the partition being located on the side wall proximate the refrigerant supply port, the second partition directing the refrigerant into the hole formed in the cylindrical wall of the refrigerant suction port.

15. The suction muffler of claim 1 wherein the refrigerant suction pipe includes an upper inlet and a refrigerant suction port which are both located in the resonance chamber.

16. The compressor of claim 8 wherein the refrigerant suction pipe includes an upper inlet and a refrigerant suction port which are both located in the resonance chamber.

* * * * *